US010967601B2

(12) United States Patent
Boegli et al.

(10) Patent No.: US 10,967,601 B2
(45) Date of Patent: Apr. 6, 2021

(54) DEVICE FOR FINE EMBOSSING OF PACKAGING MATERIAL WITH A SET OF EMBOSSING ROLLS OF THE MALE/FEMALE EMBOSSING TYPE

(71) Applicant: Boegli-Gravures SA, Marin-Epagnier (CH)

(72) Inventors: Charles Boegli, Marin-Epagnier (CH); Werner Steffen, Stans (CH)

(73) Assignee: Boegli-Gravures SA, Marin-Epagnier (CH)

( * ) Notice: Subject to any disclaimer, the term of this patent is extended or adjusted under 35 U.S.C. 154(b) by 197 days.

(21) Appl. No.: 15/779,533

(22) PCT Filed: Dec. 14, 2016

(86) PCT No.: PCT/EP2016/080939
§ 371 (c)(1),
(2) Date: May 28, 2018

(87) PCT Pub. No.: WO2017/108516
PCT Pub. Date: Jun. 29, 2017

(65) Prior Publication Data

US 2018/0370175 A1 Dec. 27, 2018

(30) Foreign Application Priority Data

Dec. 22, 2015 (EP) ..... 15201862

(51) Int. Cl.
*B41F 19/02* (2006.01)
*B31F 1/07* (2006.01)
*B31B 50/88* (2017.01)

(52) U.S. Cl.
CPC ..... *B31F 1/07* (2013.01); *B41F 19/02* (2013.01); *B31B 50/88* (2017.08);
(Continued)

(58) Field of Classification Search
CPC ..... B31F 1/07; B31F 2201/073; B31F 2201/0733; B31F 2201/0738; B31F 2201/0743; B31F 2201/0758; B41F 19/02
See application file for complete search history.

(56) References Cited

U.S. PATENT DOCUMENTS 5,007,271 A 4/1991 Boegli
5,598,774 A 2/1997 Boegli
(Continued)

FOREIGN PATENT DOCUMENTS

AU 772613 B2 1/1913
CA 2382597 A1 11/2000
(Continued)

OTHER PUBLICATIONS

European Opinion of EP15201862.8 dated Jun. 30, 2016.
(Continued)

*Primary Examiner* — Matthew G Marini
*Assistant Examiner* — Marissa Ferguson-Samreth
(74) *Attorney, Agent, or Firm* — Andre Roland S.A.; Nikolaus Schibli

(57) ABSTRACT

The embossing device for fine embossing of packaging material has a set of embossing rolls with female embossing and male embossing rolls, in each case the structural elements (ML1) of the female embossing roll (M1) and the structural elements (PL1) of the male embossing rolls (P1) being assigned to each other, and the structural elements of one of the rolls being produced independently of the structural elements of the other rolls. At least one structural element (ML1; PL1) of at least one roll (M1, P1) is provided on its bottom surface (B1) and/or surface (S1) and/or side surfaces and/or in its immediate surroundings with light-scattering elements (DM1, D1), the height (H) of which is 10 μm to 150 μm. As a result of the use of light-scattering
(Continued)

elements with small dimensions, the contrast of the structural elements can be increased substantially, by which means the overall aesthetic image is improved considerably.

20 Claims, 7 Drawing Sheets

(52) U.S. Cl.
CPC . *B31B 2241/003* (2013.01); *B31F 2201/0733* (2013.01); *B31F 2201/0738* (2013.01); *B31F 2201/0743* (2013.01)

(56) References Cited

U.S. PATENT DOCUMENTS

| | | | | |
|---|---|---|---|---|
| 6,176,819 | B1 * | 1/2001 | Boegli | B31F 1/07 493/194 |
| 6,665,998 | B1 | 12/2003 | Boegli | |
| 6,715,411 | B1 | 4/2004 | Boegli | |
| 7,036,347 | B2 | 5/2006 | Boegli | |
| 7,147,453 | B2 | 12/2006 | Boegli | |
| 7,229,681 | B2 | 6/2007 | Boegli | |
| 8,038,922 | B2 | 10/2011 | Boegli | |
| 8,430,663 | B2 | 4/2013 | Boegli | |
| 8,495,900 | B2 | 7/2013 | Boegli | |
| 8,932,044 | B2 | 1/2015 | Boegli | |
| 9,140,834 | B2 | 9/2015 | Boegli | |
| 9,156,107 | B2 | 10/2015 | Boegli et al. | |
| 9,180,643 | B2 | 11/2015 | Boegli | |
| 9,481,141 | B2 | 11/2016 | Boegli | |
| 9,505,167 | B2 | 11/2016 | Boegli | |
| 9,579,924 | B2 | 2/2017 | Boegli | |
| 9,636,885 | B2 | 5/2017 | Boegli et al. | |
| 9,809,927 | B2 | 11/2017 | Boegli | |
| 9,939,725 | B2 | 4/2018 | Boegli et al. | |
| 9,993,895 | B2 | 6/2018 | Boegli et al. | |
| 10,083,253 | B2 | 9/2018 | Boegli et al. | |
| 10,183,318 | B2 | 1/2019 | Boegli et al. | |
| 2004/0151796 | A1 * | 8/2004 | Boegli | B29C 59/022 425/364 R |
| 2005/0279147 | A1 * | 12/2005 | Boegli | B29C 59/04 72/196 |
| 2005/0280182 | A1 | 12/2005 | Boegli | |
| 2010/0061619 | A1 | 3/2010 | Boegli | |
| 2011/0107804 | A1 * | 5/2011 | Boegli | B31F 1/07 72/39 |
| 2012/0018993 | A1 | 1/2012 | Boegli et al. | |
| 2012/0292821 | A1 | 11/2012 | Boegli | |
| 2013/0069276 | A1 * | 3/2013 | Boegli | B31F 1/07 264/293 |
| 2013/0273322 | A1 * | 10/2013 | Boegli | B31F 1/07 428/156 |
| 2014/0059977 | A1 | 3/2014 | Boegli | |
| 2015/0027083 | A1 * | 1/2015 | Polloni | B65B 19/28 53/131.4 |
| 2016/0075077 | A1 | 3/2016 | Boegli et al. | |
| 2017/0066079 | A1 | 3/2017 | Reisse et al. | |
| 2018/0220698 | A1 | 8/2018 | Boegli et al. | |
| 2018/0370175 | A1 | 12/2018 | Boegli et al. | |

FOREIGN PATENT DOCUMENTS

| | | | | |
|---|---|---|---|---|
| CA | 2367423 | C | 5/2008 | |
| DE | 202017105458 | U1 | 10/2017 | |
| DE | 202018101229 | * | 8/2018 | B31F 1/07 |
| EP | 1437213 | A1 | 7/2000 | |
| EP | 2572820 | A1 | 3/2013 | |
| EP | 2653301 | A1 | 10/2013 | |
| EP | 2842730 | A1 | 3/2015 | |
| EP | 3037253 | * | 6/2016 | B31F 1/07 |
| EP | 3251825 | * | 6/2017 | B31F 1/07 |
| EP | 3300612 | A1 | 4/2018 | |
| EP | 3415306 | A1 | 12/2018 | |
| WO | WO 2007/012215 | | 2/2007 | |
| WO | WO 2009155720 | A1 | 12/2009 | |
| WO | WO 2013156256 | A1 | 10/2013 | |

OTHER PUBLICATIONS

European Search Report of EP15201862.8 dated Jun. 30, 2016.
International Search Report (ISR) of PCT/EP2016/080939 dated Apr. 4, 2017.
Written Opinion of the International Search Authority for PCT/EP2016/080939 dated Apr. 4, 2017.

* cited by examiner

DEVICE FOR FINE EMBOSSING OF PACKAGING MATERIAL WITH A SET OF EMBOSSING ROLLS OF THE MALE/FEMALE EMBOSSING TYPE

CROSS REFERENCE TO RELATED APPLICATIONS

The present application is a United States national stage application of International patent application PCT/EP2016/080939 filed on Dec. 14, 2016 designating the United States, and claims foreign priority to European patent application EP 15201862.8 filed on Dec. 22, 2015, the contents of both documents being herewith incorporated by reference in their entirety.

The present invention relates to a device for fine embossing of packaging material with at least two embossing rolls, according to the pre-characterizing clause of patent claim 1.

Packaging foils for the tobacco industry or for the food industry have already for some time been embossed with embossing-roll devices, wherein, for example, so-called innerliners, which are wrapped around a number of cigarettes, or packaging material for chocolate, butter or similar foods, electronic components, jewellery or watches can be involved.

The so-called innerliners initially consisted of pure aluminium foils, such as domestic foils, and these were embossed in that they were led through between two rolls, of which at least one roll had a relief, the so-called logo. Until about 1980, such a pair of rolls preponderantly comprised a steel roll, on which a relief was formed, and a mating roll made of a resilient material, for example rubber, paper or Perspex. As a result of pressing the relief of the male embossing roll into the mating embossing roll=female embossing roll, the mirror-image imprint was produced.

For more demanding logos, the relief of the male embossing roll was transferred to a layer on the female embossing roll, and the depressions corresponding to the elevated points were etched out or machined out in another way. In recent times, lasers were also used for this engraving.

Since this production of female embossing rolls for demanding logos is complicated, beginning from about 1980, following the application of U.S. Pat. No. 5,007,271 from the same applicant, a so-called pin-up-pin-up system made progress, wherein two identical steel rolls having a very large number of pyramidal teeth with a lateral length at the lower edge of 0.1 to 0.4 mm interengage and emboss an innerliner running through between. Logos are produced with this device by teeth on one roll being wholly or partly removed.

As a result, it also became possible to produce so-called calendering, the previously glossy surface obtaining a matt and, as a result, also a more superior appearance as a result of the large number of small depressions which were caused by the teeth.

In parallel with the developments of embossing technology and the production of the embossing rolls, the change was also completed in the packaging materials, whereby the originally wholly metal aluminium foils were replaced by paper films, the surfaces of which were coated with thinner and thinner metal layers as a result of environmental considerations, ultimately the metal layer being sputtered on. In more recent time and also in the future, the metallization of the innerliner will become still less or vanish entirely.

At the same time, attempts are underway to move away from the classic packaging system of cigarettes packed in innerliners and this pack pushed into a carton casing, to so-called soft packs, only a wrapping film being provided to perform the two functions, namely keeping the cigarettes moist and protecting the same against the influences of external odours, on the one hand, and a certain stiffness for the mechanical protection of the cigarettes, on the other hand.

The developments in the production of the embossing rolls, in particular known from the same applicant, see, for example U.S. Pat. No. 7,036,347, led to a greater and greater range of decorative effects on the innerliners and to a greater technical offering for advertising purposes, which was applied not only in the cigarette industry but also in the food industry. Recently, however, attempts have been underway to reduce the advertising for smoking articles to a great deal or to eliminate it entirely, so that embossing the innerliner with advertising designs will no longer be possible to the previous extent. Therefore, to an increasing extent, ways are being sought to produce new decorative effects without the use of striking embossings, gold edges or such like embellishments.

New ways are also being sought for product identification which, until now, has primarily been ensured in world-wide cultivated brand names. Nowadays, for example, use is being made of so-called tactile effects, which are produced by specific surface structures of the papers or by special engravings. Textiles such as papers are provided with inflatable inks optimized for IR absorption, which produce so-called pseudo-embossings. The effect of this technique can be a noticeable relief formation, in order for example to produce a velvet-like surface or a matt effect. In the case of use for food-safe purposes, wetting techniques are, however, questionable.

In the case of tactile surfaces, the consumer identifies the product through his sense of touch. In addition, this can lead to use for Braille or for the production of hidden security features. Information produced by tactile means can be read, for example, by means of laser beams as a result of the reflectance dependent on the surfaces. Nowadays, there are also developments, the object of which is to produce acoustically audible effects by coating the surface.

Another area of the tobacco industry deals with the cigarette itself, for example with its mouthpiece, also called tipping.

The more and more restrictive legislation with regard to smoking products, and the endeavour to produce further features such as tactile, acoustic or other optical features, on the one hand, and the ever greater multiplicity of various types of packaging materials such as aluminium foils, metal-coated papers, tipping papers, hybrid films, plastic films, cardboard or semi-board, on the other hand, lead to the conventional pin-up-pin-up embossing rolls, in which both the driven roll and the mating rolls have a large number of teeth, although they can continue to be used completely and successfully for the embossing of innerliners, running up against their limit for the objectives specified above.

Known roll systems having a male embossing roll with male embossing structures and a female embossing roll with female embossing structures inversely congruent thereto can certainly widen the range of decorative elements but, because of the pair-wise fabrication and grading, are very costly in production and above all time-consuming, so that their production is not suitable for industrial embossing of, for example, metallized innerliners for the tobacco industry.

In addition, fine embossing can be ensured only with very high outlay in the production of such rolls. Added to this is the fact that, in this case, when a male embossing roll and an inversely congruent female embossing roll are used, during embossing the foil located in between is crushed in such a way that stresses arise in the transverse direction, which are unacceptable for tobacco goods papers. In addition, the result is a limit for hole formation which is difficult to manage and very high pressures are needed for a high-speed online process, wherein the embossing times lie in the millisecond range. Finally, there is a trend to use thicker papers.

In WO 2013156256 A1 from the same applicant, in order to achieve the general object of specifying a method for producing a set of embossing rolls with which it is possible to carry out fine embossing for the extremely different surface structures described of the specified materials of an extremely wide range of types in the online operation of a packaging system, it is proposed that, in a male/female embossing roll system, the female embossing surface structure be produced independently of a previously produced or physically already existing male embossing surface structure.

In the case of fine structures, this statement is sufficient, since this type of production permits a very large multiplicity of possible designs.

If, however, relatively larger freely shaped surfaces of logos are involved, their embossing with a satisfactory aesthetic quality is problematic. In order that these surfaces, for example in the case of innerliners, have the same reflectivity everywhere, the same minimum specific embossing pressure must be applied everywhere. However, this is not possible without suitable measures if there are extremely small local deviations of the geometry between male embossing and female embossing rolls, which allow the local embossing pressure to vary highly. Given excessively close tolerances and high pressures, the embossing produces holes. High pressures can impair the sandwich structure of an innerliner which, at elevated temperatures, leads to its degradation, in that varnish blotching arises on the rear side of the paper.

The solution proposed in EP 2 842 730 A1 from the same applicant, to provide the surfaces and/or side faces of the logo with facets, provides a substantial improvement in the pressing quality for a number of substrates.

In the case of certain paper underlayers, for example coloured paper, however, both the male/female structures and the structural elements with facets lead to a locally intense brilliance and therefore to aesthetically disturbing effects.

Starting from this prior art, the object of the present invention is to specify an embossing device with an embossing roll set having one male embossing and female embossing rolls each cooperating with each other, which not only permits fine embossing to be carried out for the extremely different surface structures described of the specified materials of an extremely wide range of types in the online operation of a packaging system, but, furthermore, to carry out the high-quality fine embossing, striking to the eye, of demanding logos such as, for example, mythical creatures, letters and the like with visual emphasis as a result of graduating the brilliance from brilliant to matt of these logos or parts thereof, in order to achieve an improvement in the aesthetic aspect of the logo and therefore the overall image, in particular in coloured papers.

In general, fine embossing with the male/female system is understood to mean that the contours of the fine embossing structures of the rolls exhibit an overall linear error in the axial and radial direction of less than +/−10 μm and/or an angular error of less than 5°.

Further objects and advantages are given by the dependent claims and the following description.

The invention will be explained in more detail below by using drawings of exemplary embodiments, in which:

FIG. 1 shows, schematically, an embossing device having a set of embossing rolls with a male embossing roll and a female embossing roll, each of which is provided with simple structural elements assigned to each other, FIG. 1A shows, in a clear illustration from below and above, a variant of the male embossing and associated female embossing structural element from FIG. 1, FIG. 1B shows a section through two structural elements assigned to each other from FIGS. 1, 1A, FIG. 2 shows, in a plan view, a male embossing and an associated female embossing structural element, FIGS. 2A, 2B each show, schematically, a section through the male embossing and female embossing structural element, which each have light-scattering elements arranged on their surface and on the base, FIG. 3A shows, schematically in a basic sketch, an enlarged section through a male embossing and associated female embossing structural element with light-scattering elements arranged on the base of the female embossing structural element, FIG. 3B shows, schematically and in a further enlarged section, the influence of the roughness and fabrication tolerances on the light-scattering and structural elements illustrated in FIG. 3A, FIG. 4 shows a male embossing structural element, the surface of which is provided with light-scattering elements, FIG. 4A shows a section through the structural element from FIG. 4 and an associated female embossing structural element without light-scattering elements, FIG. 5 shows a female embossing structural element, the base of which is provided with light-scattering elements, FIG. 5A shows a section through the structural element from FIG. 5 and an associated male embossing structural element without light-scattering elements, FIG. 6 shows a male embossing structural element, the surroundings of which are provided with light-scattering elements, FIG. 6A shows a section through the structural element from FIG. 6 and an associated female embossing structural element without light-scattering elements, FIG. 7 shows a female embossing structural element, the surroundings of which are provided with light-scattering elements, FIG. 7A shows a section through the structural element from FIG. 7 and an associated male embossing structural element without light-scattering elements, FIG. 8 shows a male embossing structural element with side surfaces which are provided with light-scattering elements, FIG. 8A shows a section through the structural element from FIG. 8 and an associated female embossing structural element without light-scattering elements, FIG. 9 shows a female embossing structural element with side surfaces which are provided with light-scattering elements, FIG. 9A shows a section through the structural element from FIG. 9 and an associated male embossing structural element without light-scattering elements, FIG. 10 shows a two-step male embossing structural element, the surroundings of which are provided with light-scattering elements, FIG. 10A shows a section through the structural element from FIG. 10 and an associated female embossing structural element without light-scattering elements, FIG. 11 shows a multi-step male embossing structural element, the surroundings of which are provided with light-scattering elements, FIG. 11A shows a section through the structural element from FIG. 11 and an associated female embossing structural element without light-scattering elements, FIG. 12 shows a male embossing structural element, the surroundings of which are provided with light-scattering elements, FIG. 12A shows a section through the structural element from FIG. 12 and an associated female embossing structural element without light-scattering elements, FIG. 13 shows a view of a male embossing structural element which is provided with light-scattering elements at some points and the surroundings of which are provided with light-scattering elements, FIG. 14 shows a further male embossing structural element, which is provided with light-scattering elements at some points, FIG. 15 shows a male embossing structural element having an elevated star, which is provided with light-scattering elements at some points, and also a series arrangement of light-scattering elements.

FIG. 1 shows, schematically and simplified, a structure of an embossing device having a male embossing roll P1 and a female embossing roll Ml, wherein the female embossing roll is driven by a drive 1. The drive force of the female embossing roll on the male embossing roll is provided via a fine gear mechanism 2, 3. The male embossing roll has some structural elements PL1, which are elevated, and the female embossing roll has recessed structural elements ML1 assigned to the male embossing structural elements. The structures of the female embossing roll are produced independently of the structures of the male embossing roll, for example by means of a laser system, and are therefore non-inversely congruent, by which means they are given improved contrast. In the current prior art, however, other types of production such as engraving, etching or milling are possible.

In the present exemplary embodiment, the surfaces S1 of the male embossing structural elements PL1, the male embossing roll P1 and the bases B1 of the female embossing structural elements ML1 are provided with light-scattering elements D1 and DM1.

FIG. 1A is a clear illustration from below and above. Herein, as a design variant, the structural elements PL1A and ML1A are implemented in the shape of an L and both have the light-scattering elements D1, DM1. FIG. 1B shows a section through two structural elements PL1, ML1 or PL1A, ML1A that are assigned to each other. For simplicity, here the light-scattering elements are designed as square pyramids.

FIG. 2 reveals that the light-scattering elements D2 of the male embossing in this example are flattened pyramids with a square base and a peak spacing E1, a foot width E2 and a height H1. The overall height of the male embossing structural element is H2. The dimensions for the light-scattering elements DM2 of the female embossing structural element ML2, E3, E4, H3, H4 are slightly different from those of the associated male embossing structural element.

As a result of the scattering effect of the light-scattering elements, a matt appearance is produced at these points. The contrast which is produced with the surroundings as a result increases the perception of the logo. The exact shape or dimension of the light-scattering elements is not important within certain limits for the light scattering that is produced, since it lies at the perceptibility limit for the human eye. Thus, the light-scattering elements, instead of being formed in the shape of pyramids with a square, can also be formed with a rectangular or another cross section, or have a conical, half-round or half-moon shape or any other shape.

As emerges from the following figure descriptions, the light-scattering elements can be arranged either only on the male embossing structural elements or only on the female embossing structural elements or on both structural elements or on all or individual side surfaces of the structures or around structures.

In a departure from the idealized representation of the light-scattering elements in FIG. 2, in FIG. 3A the structural elements and light-scattering elements are also illustrated schematically but rather more as actually produced, that is to say taking into account the fabrication tolerances. Here, H1 designates the overall depth of the female embossing structural element ML3, $H2_{mit}$ the average and $H_{2max}$ the maximum height of the light-scattering elements N1-N5. In this example, the overall depth H1 varies in a range of 250 μm, and the average height of the light-scattering elements by 50 μm. The overall depth H1 of the female embossing structural element can be between 25 μm and 400 μm. The associated male embossing structural element PL3 is likewise indicated, the height of which is of the same order of magnitude as the depth of the female embossing structural element.

In FIG. 3B, the roughness of the roll steel and the fabrication tolerances are drawn by way of example on an enlarged scale. Here, RF1 and RF2 denote the maximum roughness values of the female embossing and male embossing structural elements in micrometres, which are here assumed to lie between 3 μm and 5 μm. H is the average height of the light-scattering elements N1 to N5, which means the arithmetic means of all five elements assumed here lies around 50 μm. N is an exemplary number of elements, which can be equal or different in the two coordinate directions.

In order that the light-scattering elements meet the requirements, the following conditions must be fulfilled:

a) The pressing surfaces on the uppermost surface, see also FIG. 2, must be flat and sufficiently large but not too large, in order to ensure a usable imprint,
b) the foot width=cross-sectional diameter at the base of the light-scattering elements, or the side length of the light-scattering elements, must be at least 10 μm.
c) the height Hk of the light-scattering elements should be between 10 μm and 80 μm with small step length=pitch or period of the engraving of the light-scattering elements of 80 μm and 200 μm; and
d) the height Hg of the light-scattering elements should be between 80 μm and 150 μm with step length between 200 μm and 450 μm;
e) the number of light-scattering elements N in regular M/F structures must be at least equal to 2 per structural element, N=[2, 3, 4, . . . ],
f) the heights and number of light-scattering elements in free M/F structures is like c) or d) and e), according to design requirement.

Here:

$$Hk=Rf1+H+Rf2$$

$$Hg=Rf1+H+Rf2$$

H is the average height (=arithmetic mean formed from all heights belonging to N1, N2, . . . ).

Figure 1:
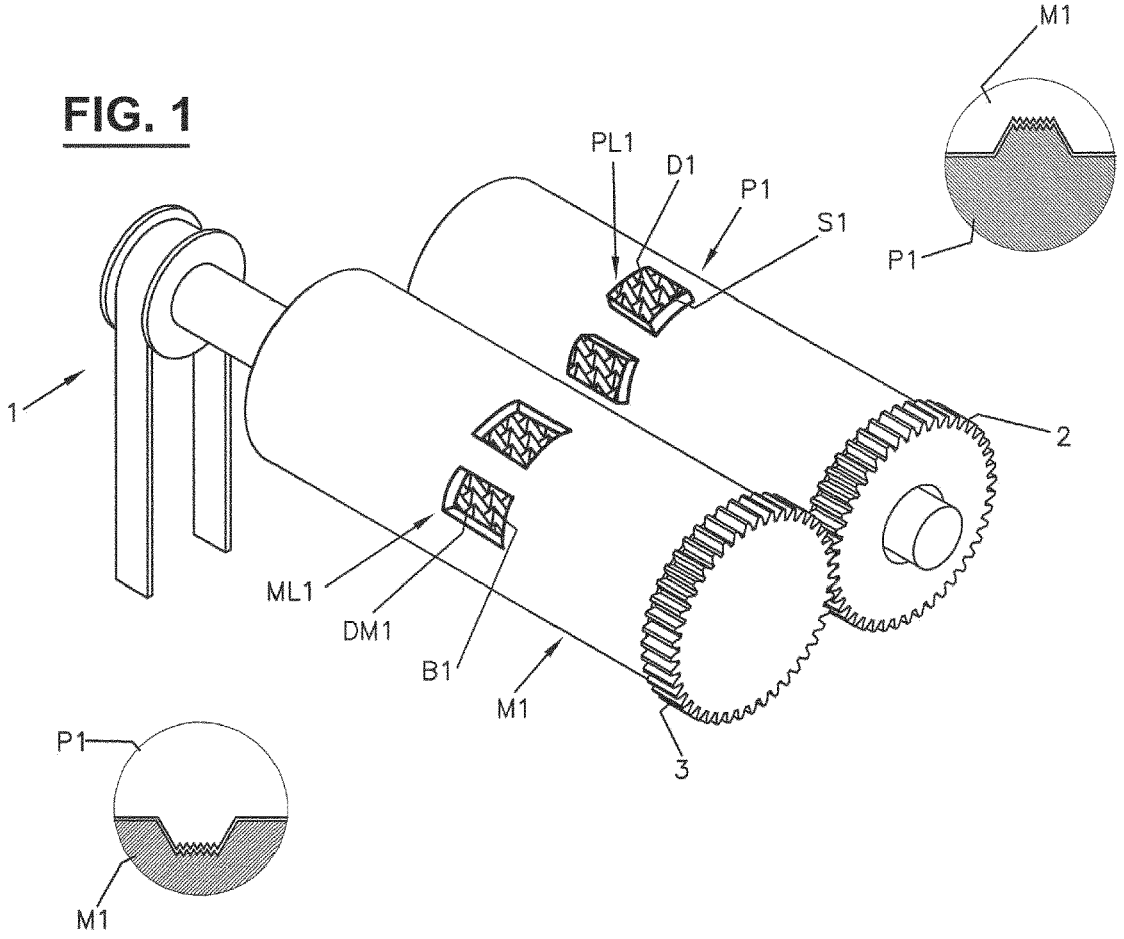
Figure 1A:
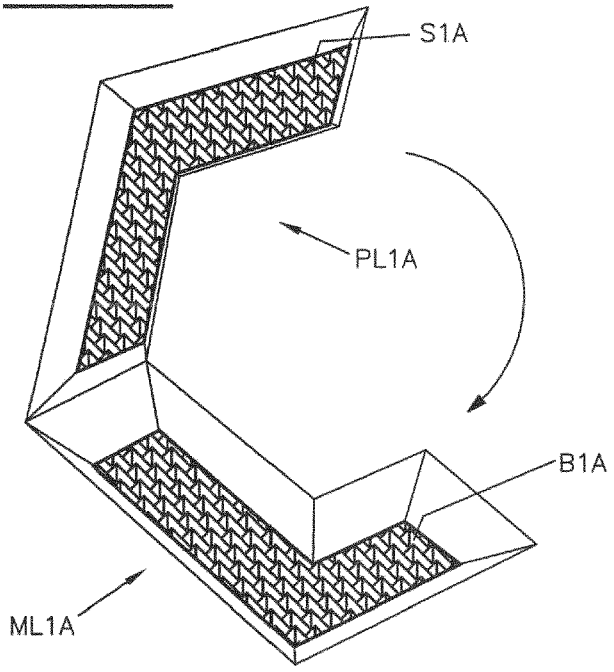
Figure 1B:
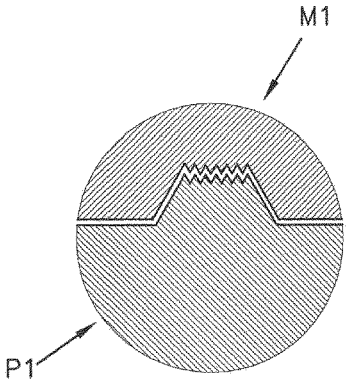
Figure 2:
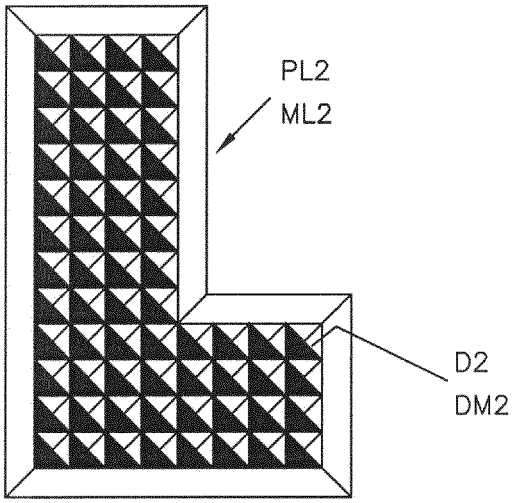
Figure 2A:
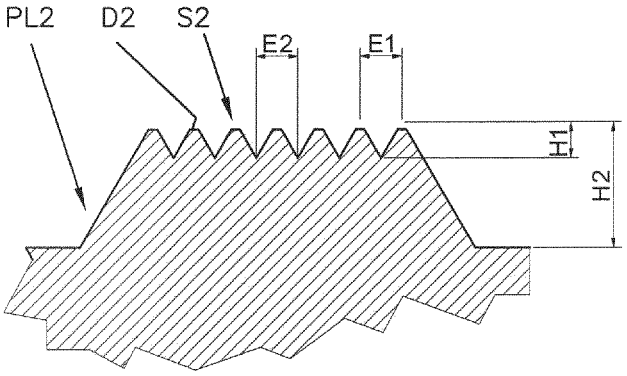
Figure 2B:
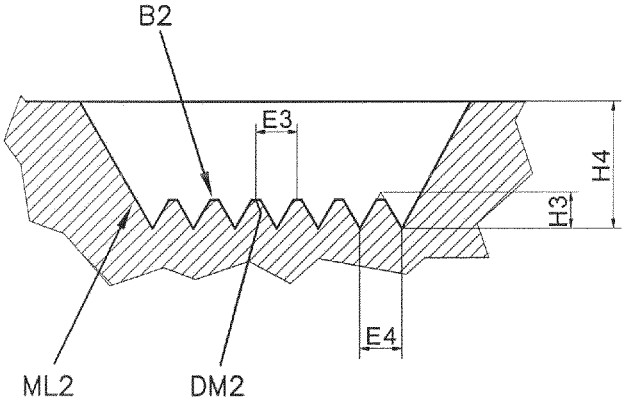
Figure 3A:
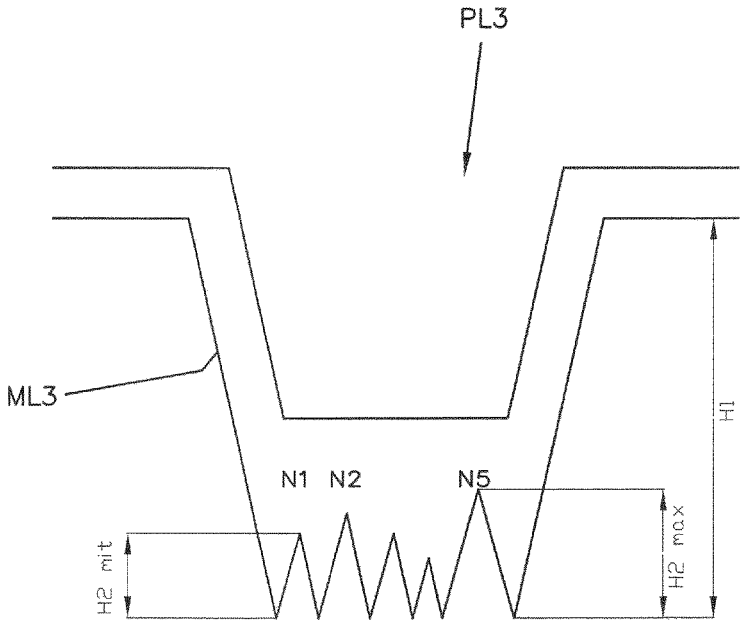
Figure 3B:
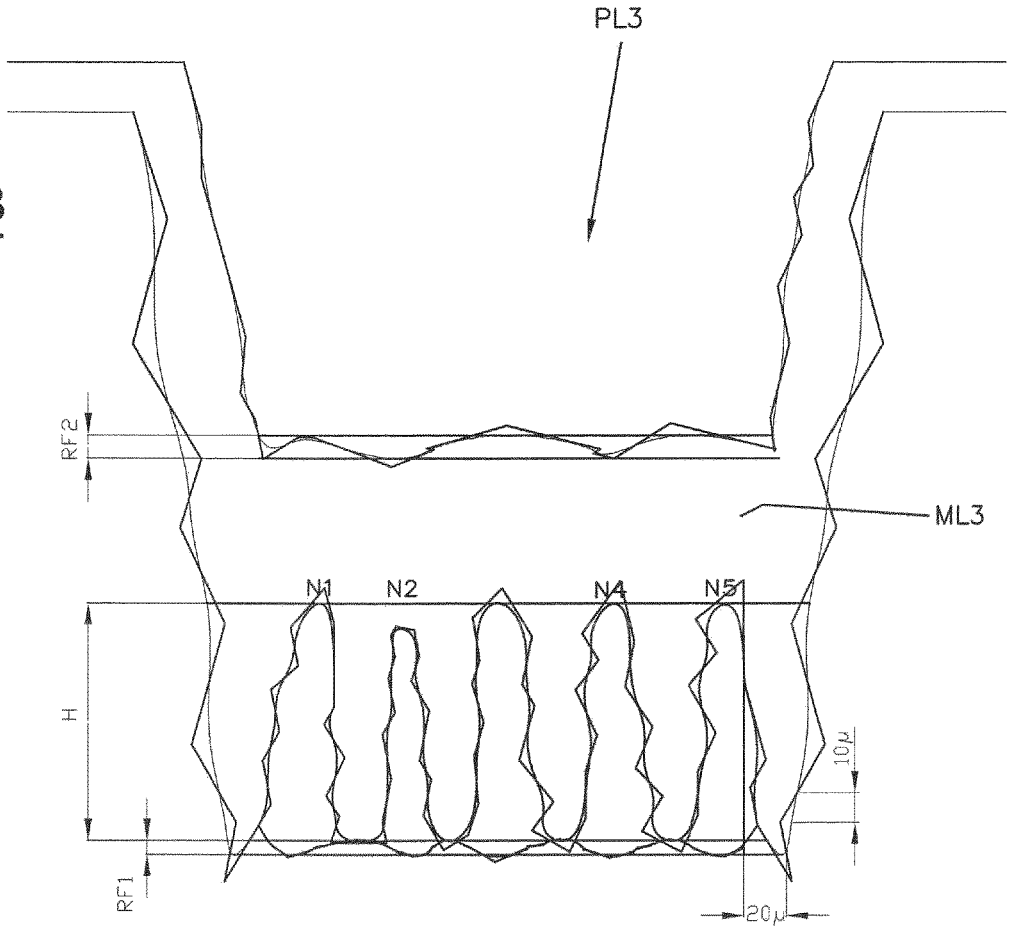
Figure 4:
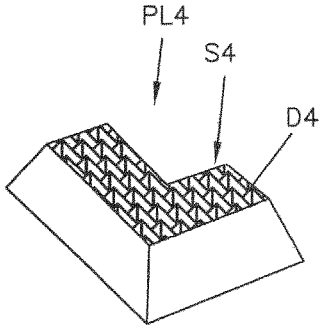
FIG. 4 shows a male embossing structural element PL4 on male embossing roll P4 with light-scattering elements D4 on the upper side S4.
Figure 4A:
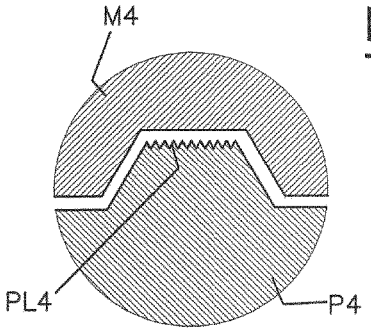
FIG. 4A shows a section together with the associated female embossing structural element ML4 in female embossing roll M4 without light-scattering elements.
Figure 5:
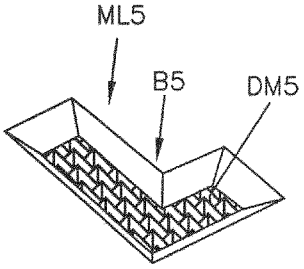
FIG. 5 shows a female embossing structural element ML5 in female embossing roll M5 with light-scattering elements D5 on the base B5 and, in the section of FIG. 5A, with the associated male embossing structural element PL5 on male embossing roll P5 without light-scattering elements.
Figure 5A:
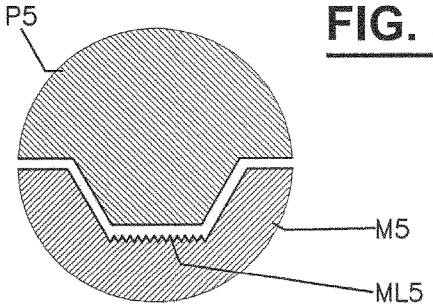
Figure 6:
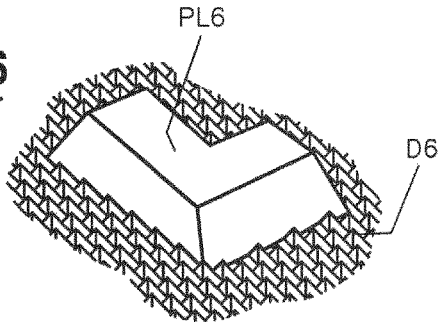
FIG. 6 shows a male embossing structural element PL6 on male embossing roll P6 without light-scattering elements with light-scattering elements D6 arranged around the structural element, and, in the section of FIG. 6A, together with the associated female embossing structural element ML6 in female embossing roll M6 without light-scattering elements.
Figure 6A:
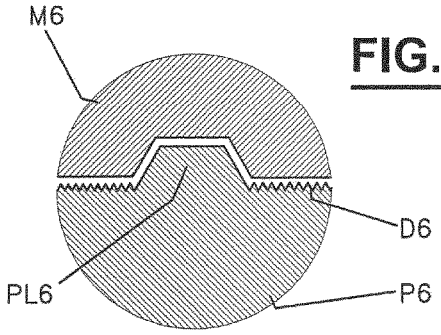
Figure 7:
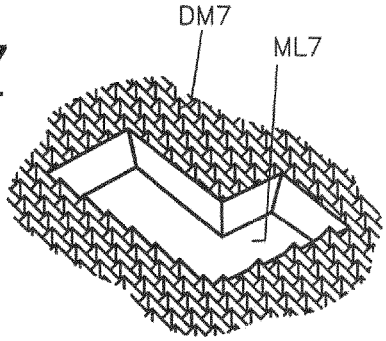
FIG. 7 shows a female embossing structural element ML7 in female embossing roll M7 without light-scattering elements with light-scattering elements DM7 arranged around the structural element and, in the section of FIG. 7A, together with the associated male embossing structural element PL7 on male embossing roll P7 without light-scattering elements.
Figure 7A:
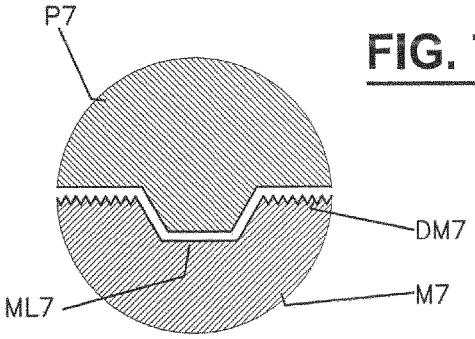
Figure 8:
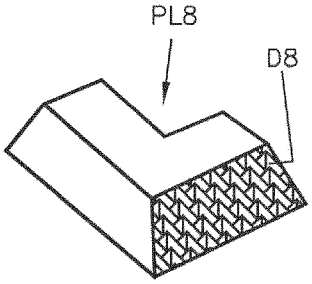
FIG. 8 shows a male embossing structural element PL8 on male embossing roll P8 with light-scattering elements D8 on some side surfaces and, in the section of FIG. 8A, together with the associated female embossing structural element ML8 in female embossing roll M8 without light-scattering elements.
Figure 8A:
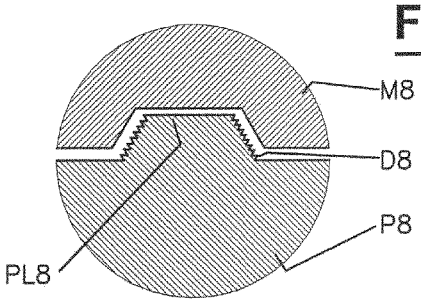
Figure 9:
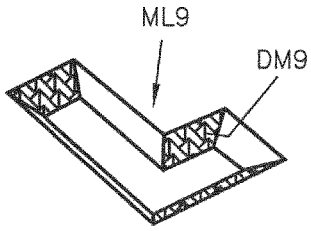
FIG. 9 shows a female embossing structural element ML9 in female embossing roll M9 with light-scattering elements DM9 on three sides and, in the section of FIG. 9A, together with the associated male embossing structural element PL9 on male embossing roll P9 without light-scattering elements.
Figure 9A:
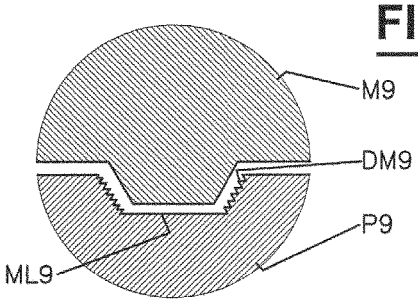
Figure 10:
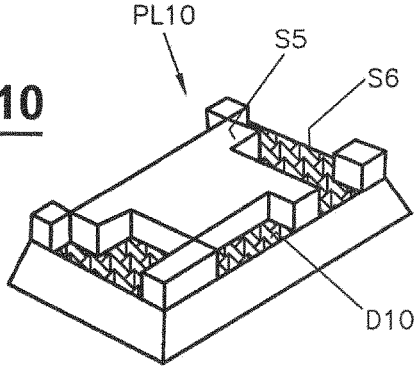
Figure 10A:
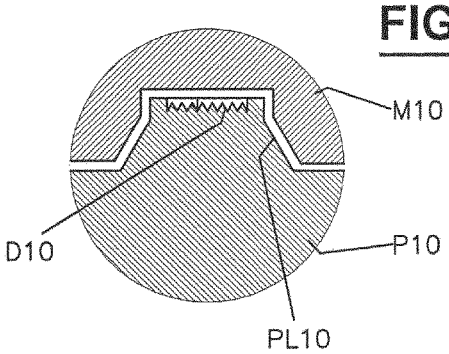

FIG. 10 shows a more complex male embossing structural element PL8 on male embossing roll P10. There are no light-scattering elements on the uppermost surface S5 but, on a lower plane S6, light-scattering elements D10 are arranged around the structures of the upper plane. The associated female embossing structural element ML10 in female embossing roll M10 shows no light-scattering elements.

Figure 11:
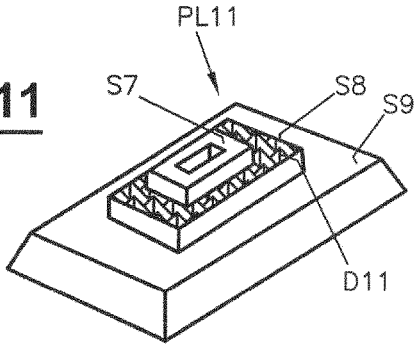
Figure 11A:
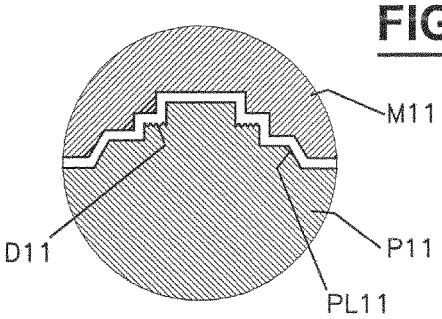

In FIG. 11, the male embossing structural element PL11 on male embossing roll P11 has three planes S7, S8, S9, wherein the uppermost plane S7 has no light-scattering elements, the central plane S8 has light-scattering elements D11, and the lowest plane S9 in turn has no light-scattering elements. The female embossing structural elements ML11 in female embossing roll M11 have no light-scattering elements.

Figure 12:
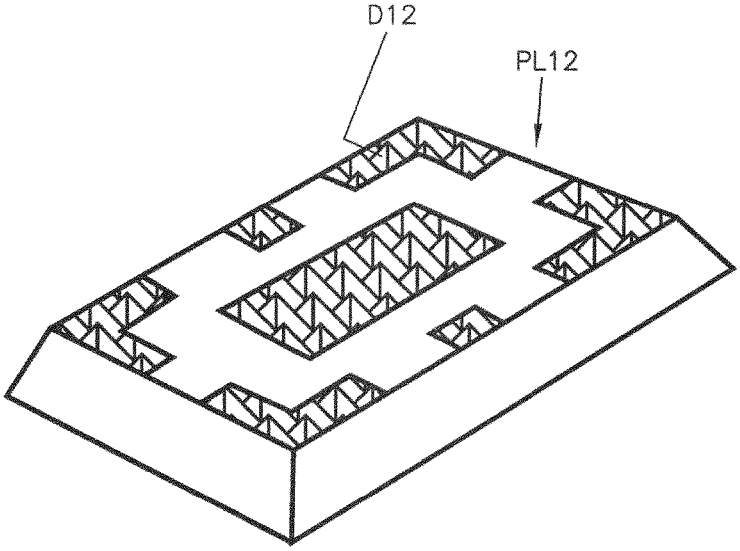
Figure 12A:
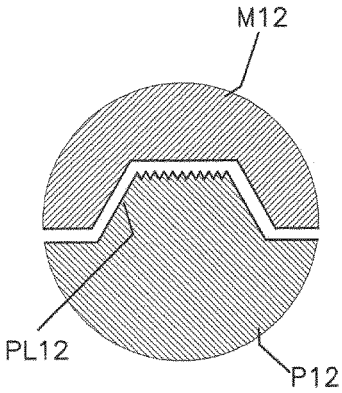

According to FIG. 12, the male embossing structural element PL12 has various logos, wherein the innermost logo L12 can also be coloured. The light-scattering elements D12 are arranged around the structural element PL12.

Figure 13:
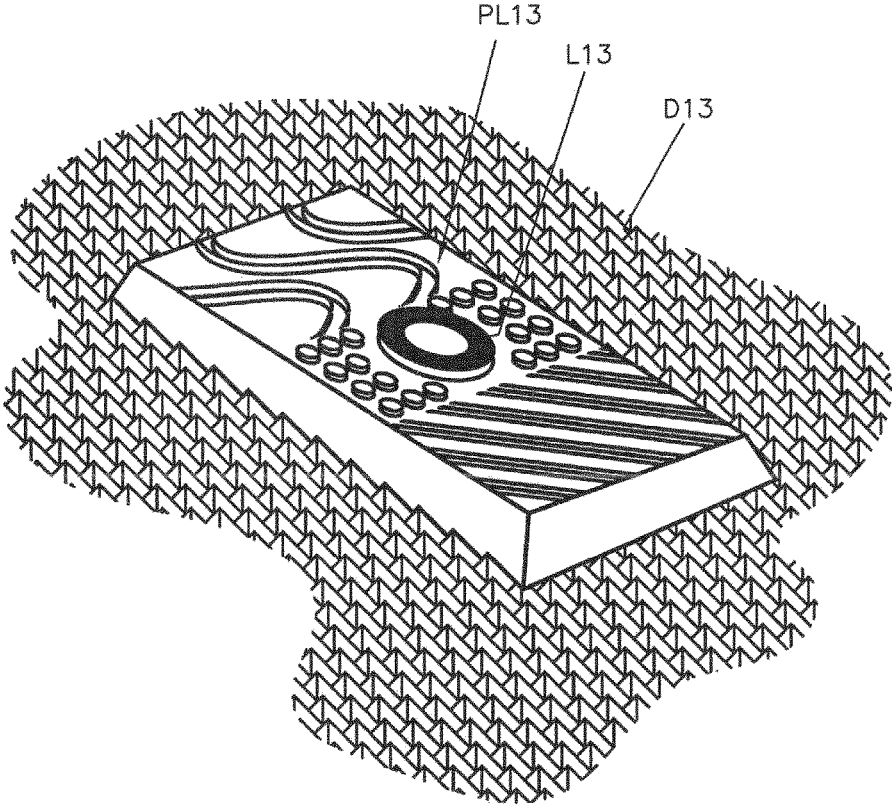

FIG. 13 shows a further complex male embossing structural element PL13, which has a plurality of planes. The logos contain a circle L13, around the same a plurality of any desired logos, and light-scattering elements D13 arranged around the male embossing structural element.

Figure 14:
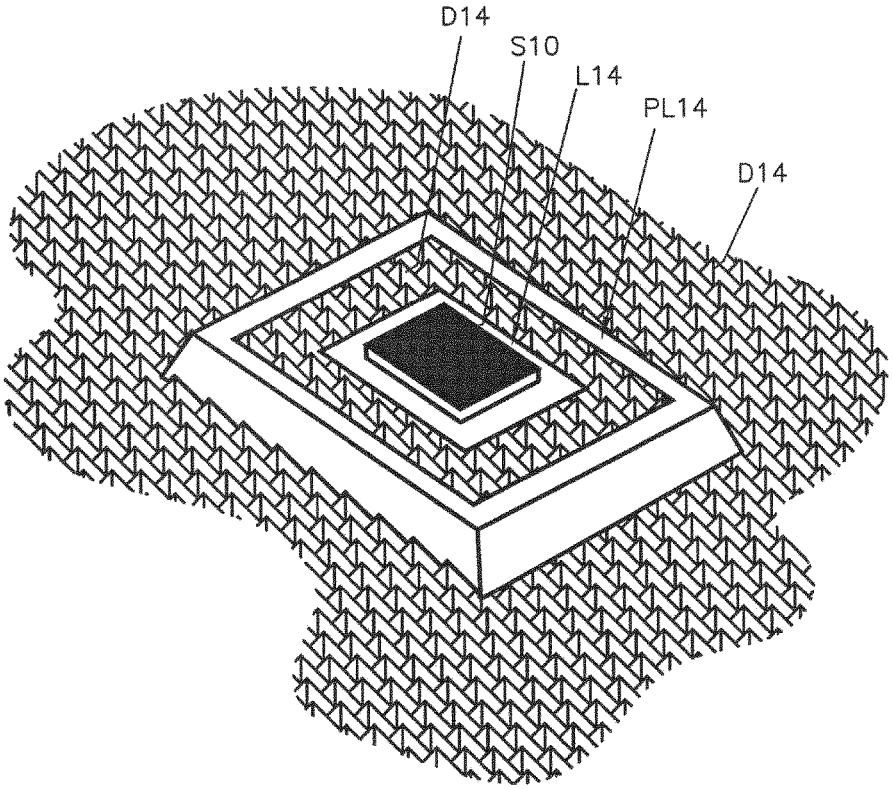

FIG. 14 shows a further complex male embossing structural element PL14, which has a plurality of logos. In the middle area S10 there is located a square L14, around the same firstly an empty surface, then light-scattering elements D14, followed by an empty border. Adjacent light-scattering elements D14 are likewise arranged around the structural element.

Figure 15A:
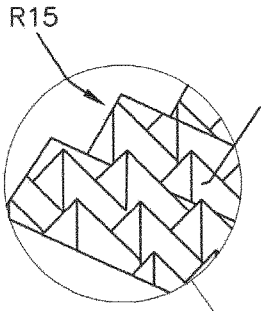
Figure 15:
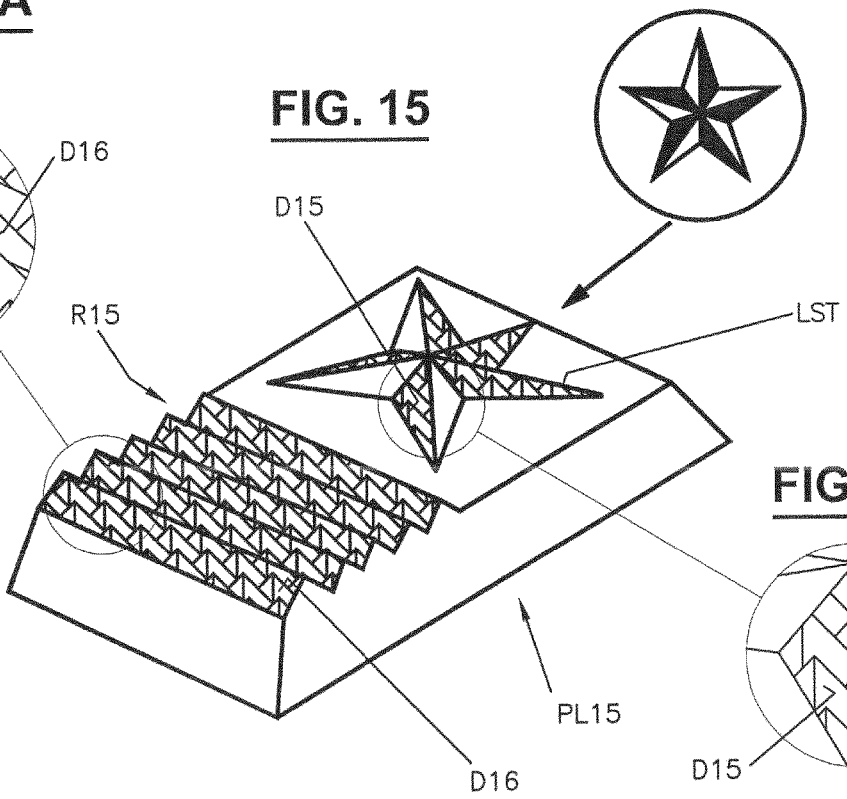
Figure 15B:
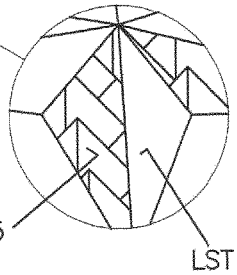

FIG. 15 shows a further male embossing structural element PL15 having an elevated star LST, the arms of which are alternately provided with light-scattering elements D15 and, beside the star, webs R15 with a triangular profile, on which light-scattering elements D16 are arranged. These structures can be seen better in the appended enlargements.

As mentioned further above, for simplicity all the light-scattering elements are shown as pyramids with a square cross section; however trials have shown that a multiplicity of other shapes such as half-round, half-moon-shaped or conical produce similar and, under certain circumstances, even better results.

Female embossing structural elements assigned to the female embossing roll correspond to the male embossing structural elements shown in FIGS. 13 to 15.

The invention claimed is:

1. An embossing device for fine embossing of packaging material to produce contrast-enhanced features with a set of embossing rolls including a female embossing roll and a male embossing roll, structural elements of the female embossing roll and structural elements of the male embossing roll assigned to each other, wherein a structural element of an embossing roll from the set of embossing rolls includes light-scattering elements, the light-scattering elements arranged to form a matrix of protrusions with individual protrusions arranged in two different directions on at least one of a bottom surface, a side surface, a plane, and an immediate surrounding of the structural element, a height HK of the protrusions being in a range between 10 μm and 80 μm, having a period of adjacent protrusions between 80 μm and 200 μm in the two different directions, and the protrusions having a foot width of at least 10 μm.

2. The embossing device according to claim 1, wherein the protrusions include pyramids with a square base.

3. The embossing device according to claim 1, wherein the protrusions include pyramids with a rectangular base, are conically-shaped, are half-round-shaped, or half-moon-shaped.

4. The embossing device according to claim 1, wherein the light-scattering elements are arranged on a lower plane, central plane, or upper side of a surface of the structural element of the male embossing roll, and the associated structural element of the female embossing roll includes no light-scattering elements.

5. The embossing device according to claim 1, wherein the light-scattering elements are arranged on a base of the structural element of the female embossing roll, and the associated structural element of the male embossing roll has no light-scattering elements.

6. The embossing device according to claim 1, wherein the light-scattering elements are arranged both on a base of the structural element of the female embossing roll and on a corresponding surface of the structural element of the male embossing roll.

7. The embossing device according to claim 1, wherein the immediate surrounding of the structural elements are provided with light-scattering elements.

8. The embossing device according to claim 1, wherein the depth or height of the structural elements is 25 μm to 400 μm.

9. The embossing device according to claim 1, wherein the light-scattering elements cover an entire surface of at least one of the bottom surface, the side surface, the plane, and the immediate surrounding of the structural element.

10. The embossing device according to claim 1, wherein a surface roughness of at least one of the bottom surface, the side surface, the plane, and the immediate surrounding of the structural element without the light-scattering elements is between 3 μm and 5 μm.

11. The embossing device according to claim 1, wherein the protrusions include tapered elements with flattened tops.

12. The embossing device according to claim 1, wherein the height HK follows the following equation:

$$HK=RF1+H+RF2,$$

in which RF1 denotes a maximal surface roughness value of surfaces of the female embossing roller, RF2 denotes a maximal surface roughness value of surfaces of the male embossing roller, and H denotes an average height of the protrusions for a corresponding structural element.

13. An embossing device for fine embossing of packaging material to produce contrast-enhanced features with a set of embossing rolls including a female embossing roll and a male embossing roll, structural elements of the female embossing roll and structural elements of the male embossing roll assigned to each other, wherein a structural element of an embossing roll from the set of embossing rolls includes light-scattering elements, the light-scattering elements arranged to form a matrix of protrusions with individual protrusions arranged in two different directions on at least one of a bottom surface, a side surface, a plane, and an immediate surrounding of the structural element, a height HG of the protrusions being in a range between 80 μm and 150 μm, having a period of adjacent protrusions between 200 μm and 450 μm in the two different directions, and the protrusions having a foot width of at least 10 μm.

14. The embossing device according to claim 13, wherein the light-scattering elements cover an entire surface of at least one of the bottom surface, the side surface, the plane, and the immediate surrounding of the structural element.

15. The embossing device according to claim 13, wherein the depth or height of the structural elements is 25 μm to 400 μm.

16. The embossing device according to claim 13, wherein a surface roughness of at least one of the bottom surface, the side surface, the plane, and the immediate surrounding of the structural element without the light-scattering elements is between 3 μm and 5 μm.

17. The embossing device according to claim 13, wherein the protrusions include tapered elements with flattened tops.

18. The embossing device according to claim 13, wherein the height HG follows the following equation:

$$HG=RF1+H+RF2,$$

in which RF1 denotes a maximal surface roughness value of surfaces of the female embossing roller, RF2 denotes a maximal surface roughness value of surfaces of the male embossing roller, and H denotes an average height of the protrusions for a corresponding structural element.

19. The embossing device according to claim 13, wherein the protrusions include pyramids with a square base.

20. The embossing device according to claim 13, wherein the protrusions include pyramids with a rectangular base, are conically-shaped, are half-round-shaped, or half-moon-shaped.

* * * * *